US009936853B2

(12) United States Patent
Choi et al.

(10) Patent No.: US 9,936,853 B2
(45) Date of Patent: Apr. 10, 2018

(54) DISHWASHER

(71) Applicant: LG Electronics Inc., Seoul (KR)

(72) Inventors: Yongjin Choi, Seoul (KR); Jongmin Lee, Seoul (KR); Soohan Eo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 182 days.

(21) Appl. No.: 14/663,910

(22) Filed: Mar. 20, 2015

(65) Prior Publication Data

US 2015/0265133 A1 Sep. 24, 2015

(30) Foreign Application Priority Data

Mar. 21, 2014 (KR) ..... 10-2014-0033549

(51) Int. Cl.
*A47L 15/42* (2006.01)

(52) U.S. Cl.
CPC ..... *A47L 15/4285* (2013.01); *A47L 15/4217* (2013.01); *A47L 15/4234* (2013.01); *A47L 15/4246* (2013.01); *A47L 15/4257* (2013.01)

(58) Field of Classification Search
None
See application file for complete search history.

(56) References Cited

U.S. PATENT DOCUMENTS

2004/0187898 A1* 9/2004 Chen ..... A47L 15/0002 134/58 D
2009/0007941 A1* 1/2009 Kim ..... A47L 15/4234 134/107

FOREIGN PATENT DOCUMENTS

KR 10-2013-0070275 * 6/2013

* cited by examiner

*Primary Examiner* — Michael Barr
*Assistant Examiner* — Jason Riggleman
(74) *Attorney, Agent, or Firm* — Dentons US LLP

(57) ABSTRACT

Disclosed is a dishwasher. The dishwasher includes a washing tub to form a dish receiving space; a sump disposed at a lower side of the washing tub; a heater which heats washing water received in the sump to generate a stream; a dish rack disposed inside the washing tub so that a plurality of dishes are inserted and stand; and a steam nozzle disposed in a direction facing edges of the plurality of dishes to flow the stream between gaps of the dishes inserted into the dish rack.

16 Claims, 11 Drawing Sheets

DISHWASHER

CROSS-REFERENCE TO RELATED APPLICATION

This application claims the priority benefit of Korean Patent Application No. 10-2014-0033549, filed on Mar. 21, 2014, in the Korean Intellectual Property Office, the disclosure of which is incorporated herein by reference.

BACKGROUND

1. Field of the Invention

The present invention relates to dishwasher, and more particularly to a stream nozzle for uniformly increasing a temperature of a washing tub.

2. Description of the Related Art

A dishwasher is a home appliance which cleans food waste attached on a surface of dishes by washing water at high pressure injected from a washing arm.

In general, the dishwasher includes a tub to form a washing chamber and a sump mounted at a bottom surface of the tub to store the washing water. Further, the washing water is moved to the washing arm by a pumping operation of a washing pump which is mounted inside the sump. The washing water moved to the washing arm is sprayed at high pressure through a spray hole which is formed in the washing arm. Moreover, the washing water sprayed at high pressure collides with a surface the dishes so that filth such as food waste attached to the dishes falls on a bottom of the tub. The used washing water is separated from the filth and is collected in the sump to be exhausted to the outside.

According to the related art, in order to reinforce washing force of the dishwasher, steam is sprayed into the washing tub. In a case where the steam is moved into the tub, if a moving distance is increased, a condensing amount of the steam is increased. Accordingly, since heat energy of the steam is not diffused into the tub, a steam nozzle according to the related art is located at a lateral side of the tub. However, when the steam is sprayed from the lateral side of the tub, since the steam is directly sprayed to a space in which foods are received, the steam collides with the dishes so that the steam is not uniformly diffused into the washing tub.

SUMMARY OF THE DISCLOSURE

The present invention provides dishwasher capable of uniformly spraying steam into a washing tub.

The present invention further provides a dishwasher capable of uniformly increasing washing force with respect to dishes which is disposed inside a washing tub.

The present invention further provides dishwasher capable of minimizing a space of a heater to generate steam.

The present invention further provides dishwasher capable of reusing high temperature water remaining after the steam is generated.

The present invention further provides dishwasher capable of preventing a moving path of steam from being blocked by arrangement of dishes.

In accordance with an aspect of the present invention, there is provided a dishwasher including: a washing tub to form a dish receiving space; a sump disposed at a lower side of the washing tub; a heater which heats washing water received in the sump to generate a stream; a dish rack disposed inside the washing tub so that a plurality of dishes are inserted and stand; and a steam nozzle disposed in a direction facing edges of the plurality of dishes to flow the stream between gaps of the dishes inserted into the dish rack.

The washing tub may include an entrance in which dishes are brought in a forward direction of the washing tub, and a rear sidewall facing the entrance provided in a backward direction of the washing tub so that the dish receiving space is formed, and the steam nozzle may be disposed at the rear sidewall to spray the steam toward the entrance.

The dishwasher may further include a door to open/close the washing tub, and the steam nozzle may be disposed in the washing tub and may spray the steam toward the door.

The dish rack may include a lower rack which is disposed at a lowest end of the dish rack, and the steam nozzle sprays the steam between a bottom end of the lower rack and a bottom of the washing tub.

The dish rack may be disposed to be plural in number by heights, and the steam nozzle may spray the steam between the plurality of dish racks.

The dishwasher may further include: a washing arm to spray the washing water to the dish receiving space; and a water guide to supply the washing water received in the sump to the washing arm, wherein the steam nozzles may be disposed at right and left sides of the water guide, respectively.

The dishwasher may further include: a washing arm to spray the washing water to the dish receiving space; and a washing pump to supply washing water received in the sump to the washing arm, wherein the heater may be provided inside the washing pump.

The washing pump may include: a body to form a space in which the washing water is rotated; an inlet port in which the washing water is introduced; an exhaust port to exhaust the washing water; and a steam port to exhaust the steam.

The dishwasher may further include a washing motor to generate power for sucking and exhausting the washing water, wherein a top end and a bottom end of the body may be open, the washing motor may be disposed at the top end of the body, and the heater may be disposed at the bottom end of the body.

The dishwasher may further include: a steam guide to connect the pump with the steam nozzle; and a check valve to block a reverse flow of the washing water to the steam guide from the washing tub through the steam nozzle.

In accordance with an aspect of the present invention, there is provided a dishwasher including: a washing tub to form a dish receiving space; a sump disposed at a lower side of the washing tub; a heater which heats washing water received in the sump to generate a steam; a dish rack disposed inside the washing tub, and comprises crests protruding and troughs which are recessed so that dishes are inserted and stand; and a steam nozzle to spray a stream in a direction parallel to a longitudinal direction of the crests and the troughs.

The details of other embodiments are contained in the detailed description and accompanying drawings.

BRIEF DESCRIPTION OF THE DRAWINGS

FIG. 11(*b*) shows temperature distribution inside a washing tub when a steam is sprayed to a steam nozzle according to the present invention.

DETAILED DESCRIPTION

The advantages, the features, and schemes of achieving the advantages and features of the disclosure will be apparently comprehended by those skilled in the art based on the embodiments, which are described later in detail, together with accompanying drawings.

Various example embodiments will be described more fully hereinafter with reference to the accompanying drawings, in which some example embodiments are shown. The present inventive concept may, however, be embodied in many different forms and should not be construed as limited to the example embodiments set forth herein. In the figures, reference numbers refer to the same or equivalent parts of the present invention throughout the specification.

Hereinafter, dishwasher according to the exemplary embodiment of the present invention will be described with reference to the accompanying drawings.

Figure 1:
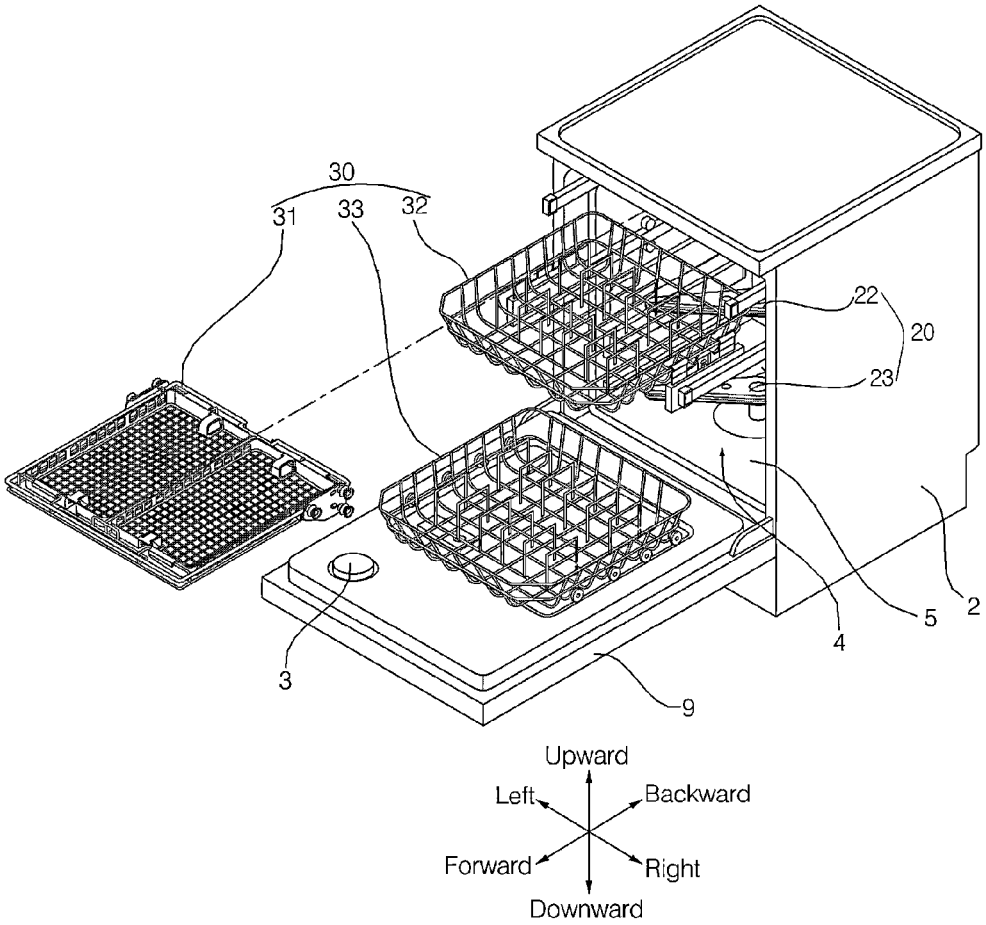
FIG. 1 is a perspective view illustrating dishwasher according to an embodiment of the present invention.
Figure 2:
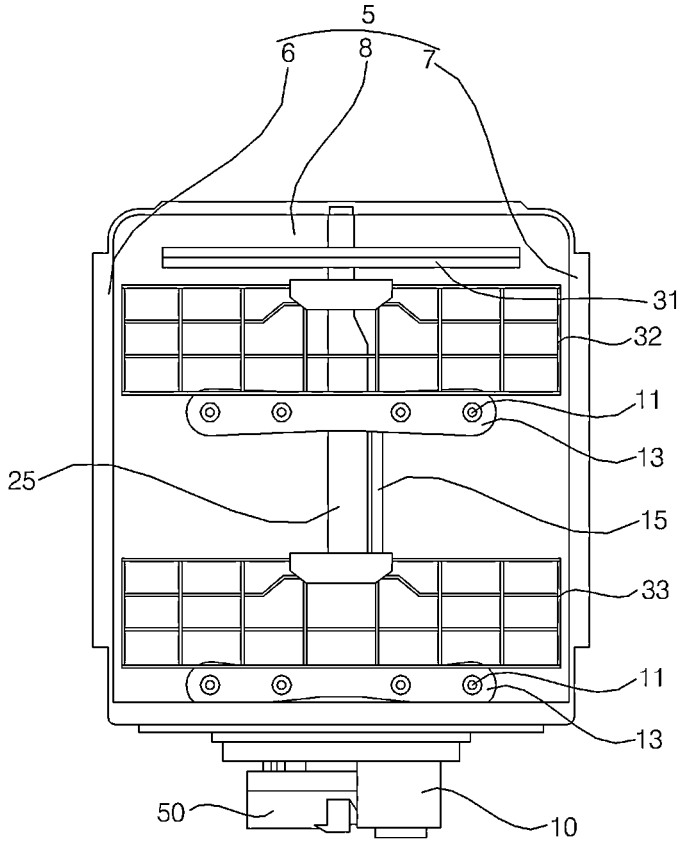
FIG. 2 is a front view illustrating dishwasher according to an embodiment of the present invention.
Figure 3:
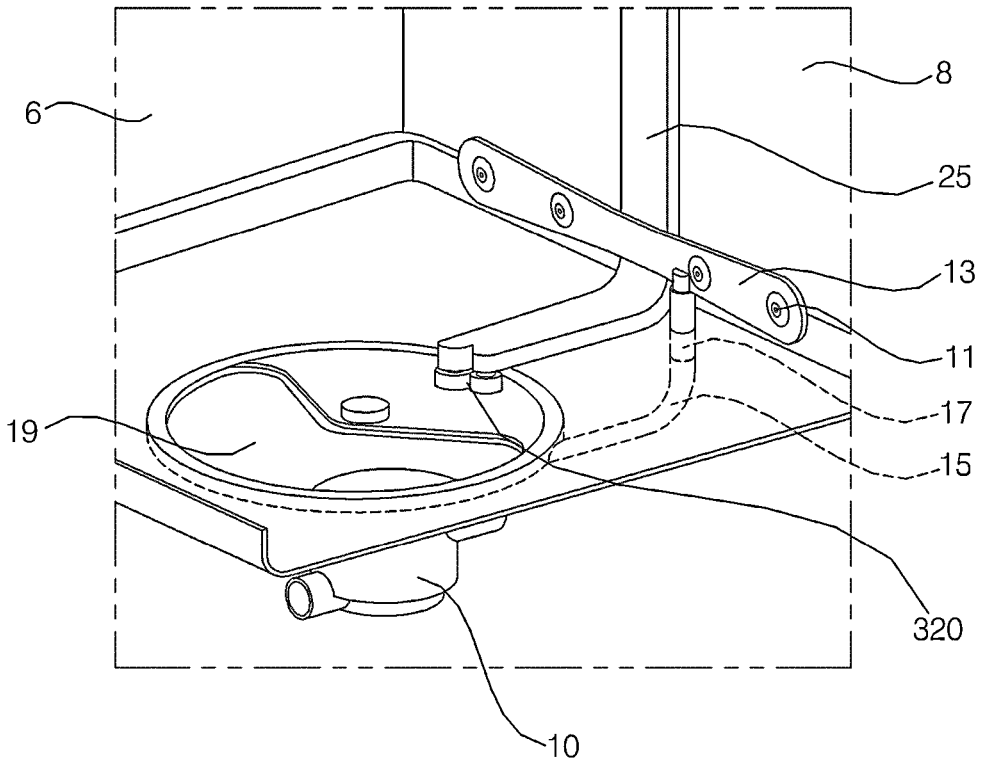
FIG. 3 is a perspective view illustrating a steam nozzle according to an embodiment of the present invention.
Figure 4:
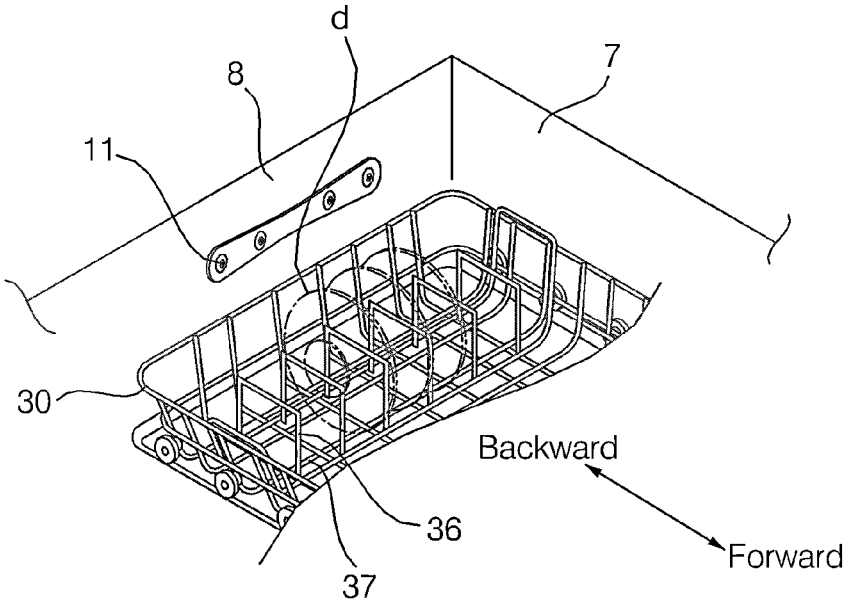
FIG. 4 is a perspective view illustrating a steam nozzle and dish rack according to an embodiment of the present invention.

FIG. 1 is a perspective view illustrating dishwasher according to an embodiment of the present invention. FIG. 2 is a front view illustrating dishwasher according to an embodiment of the present invention. FIG. 3 is a perspective view illustrating a steam nozzle according to an embodiment of the present invention. FIG. 4 is a perspective view illustrating a steam nozzle and dish rack according to an embodiment of the present invention.

A forward direction and a backward direction are described with reference to FIGS. 1 and 2.

An entrance 4 in which dishes are brought is formed in a forward direction of a washing tub 5 to form the dishwasher, and a rear sidewall 8 facing the entrance 4 is provided in a backward direction of the washing tub 5 so that a dish receiving space is formed. In the same manner, a door 9 is disposed in the forward direction of the washing tub 5, and the rear sidewall 8 facing the door 9 is formed in the backward direction of the washing tub 5. Accordingly, the forward and backward directions are a straight longitudinal direction perpendicular to a plane in which the door 9 is formed or a straight longitudinal direction perpendicular to a plane in which the rear sidewall 8 is formed.

Further, an upward direction and a downward direction are described with reference to FIGS. 1 and 2. A sump 10, a lower rack 33, and a lower arm 23 are disposed at a lower side of the washing tub 5. An upper rack 31 and an upper arm 21 are disposed at an upper side of the washing tub 5. Accordingly, the upward and downward directions are a straight longitudinal direction perpendicular to a plane in which a bottom surface of the washing tub 5 is formed or a longitudinal direction of a straight line perpendicular to a plane in which a ceiling of the washing tub 5 is formed.

Moreover, left and right directions or a transverse direction are described. A left sidewall 6 is formed at a left side of the washing tub 5, and a right sidewall 7 is formed at a right side of the washing tub 5. The left and right directions or the transverse direction are a straight longitudinal direction perpendicular to a plane in which the left sidewall 6 is formed or a straight longitudinal direction perpendicular to a plane in which the right sidewall 7 is formed.

The dish rack 30 is formed of a wire. The dish rack 30 may be injection-molded by synthetic resin. The dish racks 30 are disposed in upward and downward directions of the washing tub 5, respectively. A direction of dishes received in the dish rack 30 may be changed according to an embodiment. That is, the dishes may stand in forward and backward directions, upward and downward directions, or a longitudinal direction. As another example, the dishes may stand upright in a transverse direction or left and right directions. However, for the purpose of convenience of a description, a case where the dishes stands upright in the forward and backward directions, upward and downward directions, or the longitudinal direction so that a gap between dishes is viewed through the entrance 4 will be described by way of example.

The dishwasher according to an embodiment of the present invention includes a washing tub 5, a sump 10, a heater 60, dish rack 30, and a steam nozzle 11. The washing tub 5 forms dish receiving space. The sump 10 is disposed at a lower side of the washing tub 5. The heater 60 heats washing water received in the sump 10 to generate a stream. The dish rack 30 is disposed inside the washing tub 5, and includes crests 36 protruding and troughs 37 which are recessed so that the dishes are inserted and stand. The steam nozzle 11 sprays a stream in a direction parallel to the longitudinal direction of the crests 36 and the troughs 37.

Referring to FIG. 1 to FIG. 4, the dishwasher according to an embodiment of the present invention includes: a washing tub 5 to form dish receiving space; a sump 10 disposed at a lower side of the washing tub 5; a heater 60 to heat washing water received in the sump 10; and a steam nozzle 11 to spray a steam formed by the heater 60 in a longitudinal direction inside the washing tub 5.

The dishwasher according to an embodiment of the present invention includes: a washing tub 5 to form dish receiving space; a sump 10 disposed at a lower side of the washing tub 5; a heater 60 to heat washing water received in the sump 10 to generate a steam; a dish rack 30 disposed inside the washing tub 5 so that a plurality of dishes are inserted and stand upright; and a steam nozzle 11 facing edges d of the plurality of dishes so that a steam flows between gaps of the dishes inserted into the dish rack 30. The casing 2 forms an outer appearance of the dishwasher. The washing tub 5 is disposed inside the casing 2. An entrance 4 is formed at a front surface of the casing 2 and the washing tub 5. The door 9 is disposed in a forward direction of the casing 2 to open/close the entrance 4. The door 9 may be opened/closed in a drop-down scheme.

A blowing fan 3 for blowing internal wet air to the outside upon dehydration is installed at an inner side of the door 9. A detergent supply device for supplying detergent into the washing tub 5 after temporarily storing the detergent is installed in one of the body and the door 9.

A sump 10, a washing pump 50, and a water distribution pump 40 are provided at a lower side of the washing tub 5.

The sump 10 collects washing water. A washing pump 50 sucks and exhausts the washing water. The water distribution pump 40 exhausts the washing water accumulated in the sump 10 to the outside. A sump 10 cover is disposed at a lower side of the washing tub 5. An impeller 58 is axially coupled with a washing motor 57 and rotates the washing water. The sump 10 collects externally supplied washing water or washing water which is previously sprayed into the washing tub 5. The heater 60 heats the washing water. The heater 60 heats the washing water to generate a steam. The steam nozzle 11 sprays the steam. A spray hole formed in the steam nozzle 11 is disposed to view a transverse direction. The transverse direction includes forward and backward directions or upward and downward directions.

When the dishes stand or edges d of the dishes face the longitudinal direction, the steam nozzle 11 sprays the steam in the transverse direction. An entrance 4 in which dishes are brought is formed in a forward direction of a washing tub 5 to constitute the dishwasher, and a rear sidewall 8 facing the entrance 4 is provided in a backward direction of the washing tub 5 so that dish receiving space is formed. The steam nozzle 11 is disposed at a rear sidewall 8 and sprays the steam toward the entrance 4. The dishwasher further includes a door 9 to open/close the washing tub. The steam nozzle 11 is disposed in the washing tub 5 and sprays the steam toward the door 9. The washing tub 5 includes a left sidewall 6 formed at a left side of the entrance 4, a right sidewall 7 formed at a right side of the entrance 4, and a rear sidewall 8 facing the entrance 4. The rear sidewall 8 is connected to the right sidewall 7 and the left sidewall 6.

The steam nozzle 11 may be disposed at the door 9 and may spray the steam toward the rear sidewall 8. The steam nozzle 11 is disposed at the rear sidewall 8 and sprays the steam toward the entrance 4. The steam nozzle 11 is disposed at the rear sidewall 8 and may spray the steam toward the door 9.

The dish rack 30 forms crests 36 protruding and recessed troughs 37. The dishes are inserted into the crests 36 while being supported by the crests 36. The crest 36 and the trough 37 are plural in number. Preferably, one dish is inserted into one trough 37. The steam nozzle 11 sprays the steam between adjacent troughs 37. The steam nozzle 11 sprays the steam between adjacent crests 36. The steam nozzle 11 sprays in upward and downward directions of the crest 36 or the trough 37. A gap is formed between the dishes in the upward and downward directions of the crest 36. The steam nozzle 11 faces edges d of the dishes so that the steam flows between a gap between the dishes inserted into the dish rack 30. When the dishes stand upright in a longitudinal direction, the steam nozzle 11 sprays the steam in the longitudinal direction.

For example, a longitudinal direction of the crest 36 and the trough 37 of the dish rack 30 is disposed perpendicular to the rear sidewall 8 (parallel to forward and backward directions of the washing tub 5). The steam nozzle 11 is disposed at the rear sidewall 8 and sprays the steam toward the door 9 and/or the entrance 4. For example, the longitudinal direction of the crest 36 and the trough 37 of the dish rack 30 is disposed perpendicular to the rear sidewall 8 (parallel to forward and backward directions of the washing tub 5). The steam nozzle 11 is disposed at the door 9 and sprays the steam toward the rear sidewall 8.

The steam nozzle 11 sprays the steam between a gap in which the dishes are formed. The steam may flow without colliding with the dishes. The steam flows in a sprayed direction by inertia. When the dishes stand upright in the longitudinal direction, the steam collides with the door 9 or is moved toward the door 9. Since a ratio of the steam colliding with the dishes to be condensed is low, an amount of the steam flowing in an upper side of the dishwasher is increased. Since a temperature of the steam is high, the steam flows in an upper side of the dishes washing space. An ascending steam may be moved toward a middle rack 32 and an upper rack 31.

That is, it is possible to prevent a problem that the steam is rapidly condensed because a contact amount of the steam with the dishes is much or heat energy of the steam is all consumed at a location close to the steam nozzle 11. Accordingly, since most of the steam may maintain a gas state, a flow amount of the steam is increased. Since the flow amount of the steam is increased, the heat energy may be uniformly transferred to the dishes washing space.

The washing pump 50 sucks the washing water received in the sump 10 and then exhausts the washing water. The washing water exhausted from the washing pump 50 flows to a washing arm 20 to be described below through a water guide 25. The steam flows to the steam nozzle 11 through the steam guide 15. The steam guide 15 may be fixed to the rear sidewall 8. The steam guide 15 may be disposed parallel to the water guide 25.

The washing pump 50 may include a heater 60 therein, may spray the steam, and may exhaust the washing water. The washing pump 50 exhausts the washing water through an exhaust port 55, and sprays the steam through the steam port 56. Since the washing water and the steam are supplied from the washing pump 50, the water guide 25 on which the washing water flows is disposed close to the steam guide 15 on which the steam flows.

The steam nozzle 11 may spray the steam toward the lower rack 33. Since the steam including a great amount of heat energy ascends, the steam sprayed toward the lower rack which is disposed at the lowest location sequentially passes through the middle rack 32 and the upper rack 31 and are moved.

Since the washing pump 50 may simultaneously spray the steam and the washing water and is displayed at the sump 10, the steam is formed at a lower side of the washing tub 5. The steam is formed at a lower side of the washing tub 5 and is moved to the steam nozzle 11 facing the lower rack 33. That is, since the steam may be generated from the washing pump 50, a moving path to the steam nozzle 11 is reduced. If a time of the steam flowing through the steam guide 15 at high pressure is reduced, an amount of the steam condensed inside the steam guide 15 is reduced. Accordingly, when the same power is supplied to the heater 60, since a supply amount of the steam per unit time is increased, a washing time of the dishes is reduced and power consumption is reduced.

The dishwasher according to an embodiment of the present invention further includes a dish rack 30 which is disposed in the washing tub 5 and receives the dishes. The dish rack 30 includes a lower rack 30 which is disposed at the lowest end thereof. The steam nozzle 11 sprays the steam between a bottom end of the lower rack 30 and a bottom of the washing tub 5.

The dish rack 30 is plural in number and is at least two in number. The dish rack 30 includes a lower rack 33 on which dishes such as plates and bowls having a high height and an upper rack 31 on which dishes such as a cutlery and a culinary having a low height. Only the lower rack 33 may be disposed according to the size of the washing tub 5. The middle rack 32 may be provided between the upper rack 31 and the lower rack 33.

The dish rack 30 has a grill shape so that the washing water sprayed from the washing water sprayer is efficiently transferred to the dishes. The dish rack 30 may include a roller to be moved in forward and backward directions inside the washing tub 5. The washing tub 5 may include a rail to guide the roller.

The steam nozzle 11 may spray between the lower rack 30 and a sump cover 19. The steam is high temperature vapor so that the steam ascends inside the washing tub 5. The steam sprayed from a lower side of the lower rack 30 is moved to the upper rack 31 through the lower rack 33 and the middle rack 32.

The dishwasher according to the embodiment of the present invention further includes dish rack 30 disposed in the washing tub 5 to receive the dishes. A plurality of dish racks 30 are disposed by heights. The steam nozzle 11 sprays the steam between the plurality of dish racks 30. The steam nozzle 11 may be disposed between the upper rack 31 and the middle rack 32. The steam nozzle 11 may be disposed between the middle rack 32 and the lower rack 33. The steam nozzle 11 may spray the steam between the middle rack 32 and the lower rack 33. The sprayed steam is moved to the lower rack 33 through the middle rack 32. A plurality of steam nozzles 11 may be disposed.

The dishwasher according to the embodiment of the present invention further includes a washing arm 20 to spray the washing water to the dish receiving space and a water guide 25 to supply the washing water received in the sump 10 to the washing arm 20. The steam nozzles 11 are disposed at right and left sides of the water guide 25, respectively. The washing arm 22 sprays the washing water blown by the washing pump 50 into the washing tub 5. The washing arm 20 is rotatably disposed. A plurality of washing arms 20 may be disposed according to the heights.

Preferably, the washing arm 20 may include a lower arm 23 disposed at a bottom end of the lower rack 33 to spray the washing water toward the lower rack 33, a middle arm 22 disposed between the lower rack 33 and the middle rack 32, and an upper arm 21 disposed at an upper side of the upper rack 31.

Figure 5:
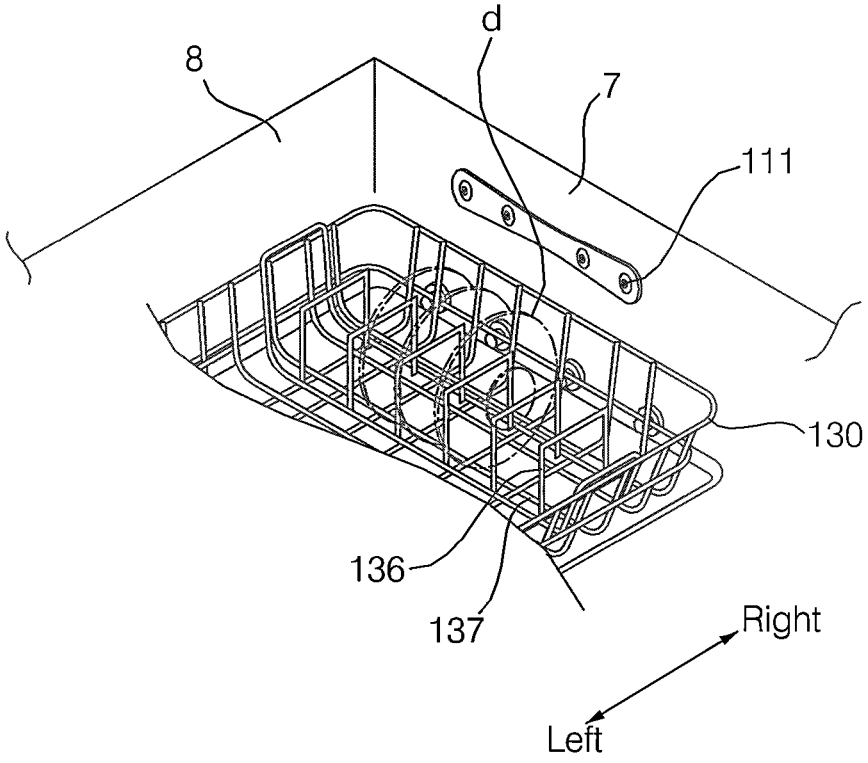
FIG. 5 is a perspective view illustrating a steam nozzle and dish rack according to another embodiment of the present invention.

FIG. 5 is a perspective view illustrating a steam nozzle and dish rack according to another embodiment of the present invention.

Referring to FIG. 5, as another example, the dishes received in the washing tub 5 may stand in a transverse direction or left and right directions. The dish rack 130 may form a crest 136 and a trough 137 to make the dishes stand. The longitudinal direction of the crest 136 and the trough 137 may include right and left directions or a transverse direction. The gap between the dishes may be the transverse direction or the right and left directions. The steam nozzle 111 may be disposed at a right sidewall 7 to spray the steam in a direction of a left sidewall 6. The steam nozzle 111 may be disposed at a left sidewall 6 to spray the steam in a direction of a right sidewall 7. The steam nozzle 111 may spray the steam in the transverse direction. The steam nozzle 111 may be disposed to move the steam in the right and left directions. In this case, a direction opposite to edges of the plurality of dishes includes right and left directions or a transverse direction.

For example, the longitudinal direction of the crest 136 and the trough 137 are aligned horizontal to the rear sidewall 8. The steam nozzle 111 is disposed at the left sidewall 6 and/or the right sidewall 7 and sprays the steam parallel to the rear sidewall 8.

Figure 6:
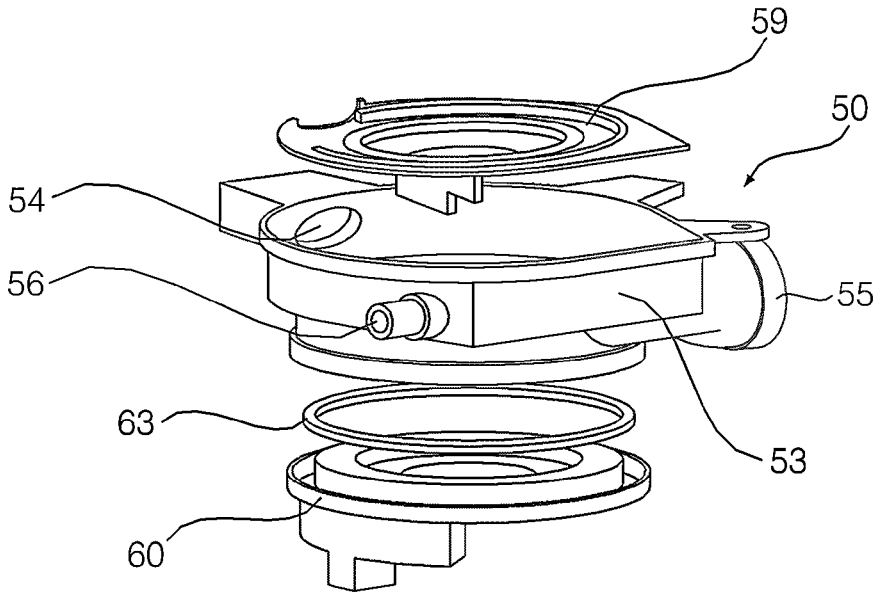
FIG. 6 is an exploded perspective view illustrating a washing pump according to an embodiment of the present invention.
Figure 7:
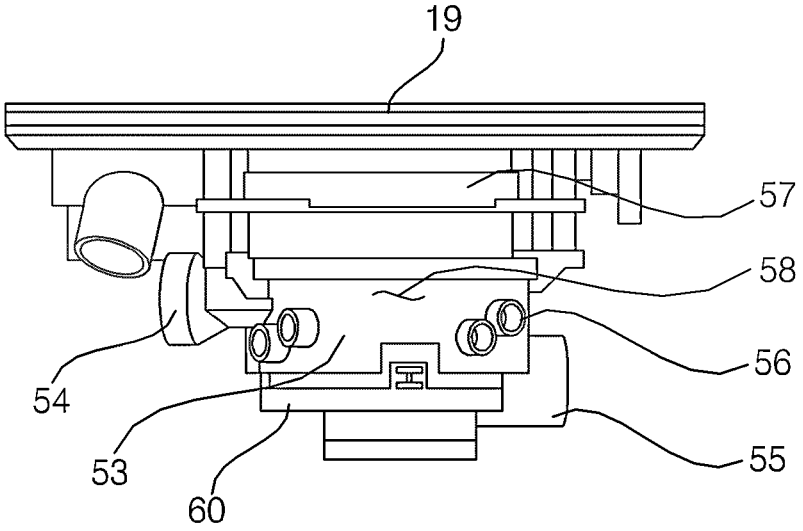
FIG. 7 is a side view illustrating a washing pump and a peripheral configuration thereof according to an embodiment of the present invention.
Figure 8:
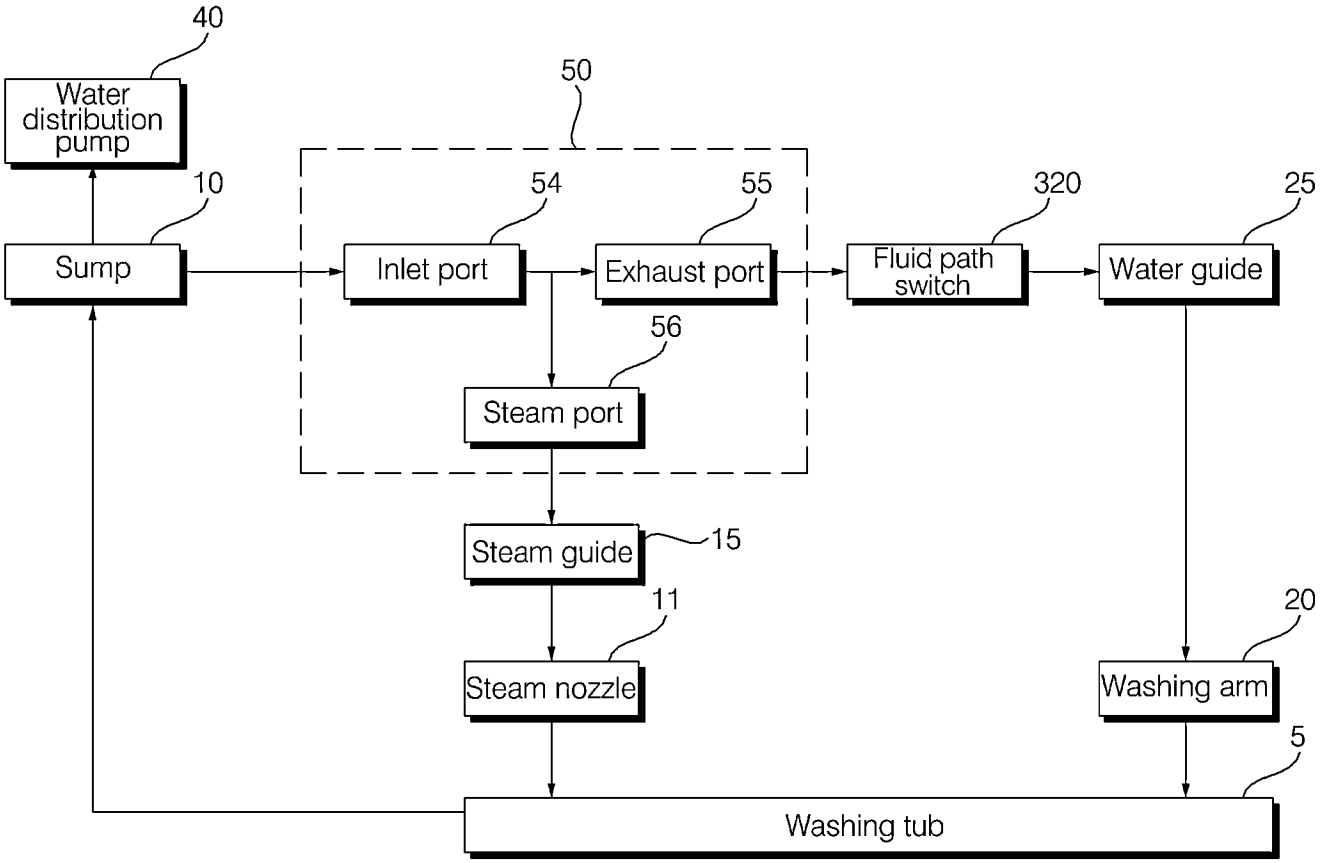
FIG. 8 is a block diagram illustrating a flow of washing water and a steam.
Figure 9:
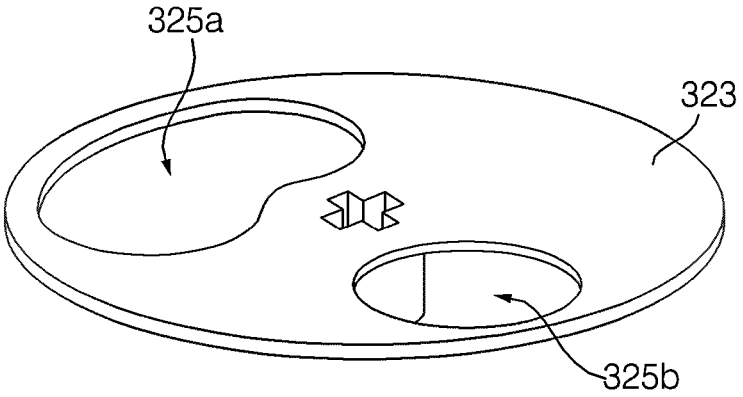
FIG. 9 is a view illustrating a rotating plate which is disposed at a fluid path switch.
Figure 10:
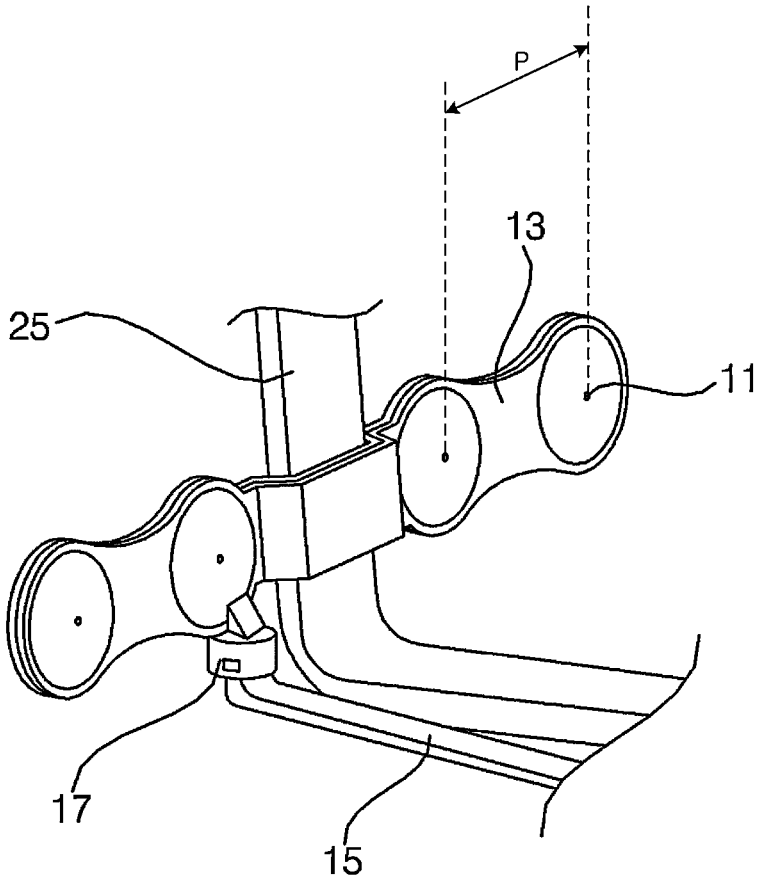
FIG. 10 is a perspective view illustrating a check valve which is disposed at a steam guide.

FIG. 6 is an exploded perspective view illustrating a washing pump according to an embodiment of the present invention. FIG. 7 is a side view illustrating a washing pump and a peripheral configuration thereof according to an embodiment of the present invention. FIG. 8 is a block diagram illustrating a flow of washing water and a steam. FIG. 9 is a view illustrating a rotating plate which is disposed at a fluid path switch. FIG. 10 is a perspective view illustrating a check valve which is disposed at a steam guide The dishwasher according to the embodiment of the present invention further includes a washing arm 20 to spray washing water to dish receiving space and a washing pump 50 to supply the washing water received in a sump 10 to a washing arm 20. The washing pump 50 is provided therein with a heater 60. The heater 60 may be disposed inside the washing pump 50 or at one side of the washing pump 50. The heater 60 heats the washing water introduced into the washing pump 50. The washing water inside the washing pump 50 is state-changed to a steam by the heater 60. The steam flows on a steam guide through a steam port 56. The washing pump 50 includes a body 53 to form a space in which the washing water is rotated; an inlet port 54 in which the washing water is introduced; an exhaust port 55 to exhaust the washing water; and a steam port 56 to exhaust the steam. The body 53 forms a space in which an impeller 58 is rotated. The body 53 may have a substantially cylindrical shape. The inlet port 54, the exhaust port 55, and the steam 56 are disposed at the body 53. The inlet port 54 is connected to the sump 10. If the impeller 58 is rotated, the washing water received in the sump 10 flows into the washing pump 50. The washing water moved to the washing pump 50 is located inside the body 53.

The exhaust port 55 is disposed at a predetermined height of the body 53. Accordingly, the washing pump 50 always receives a predetermined amount of the washing water. The heater 60 is disposed in the washing pump 50 and heats the washing water. The steam is exhausted through the steam port 56 which is disposed at the body 53. The exhaust port 55 flows the washing water to the fluid path switch 320. The fluid path switch 320 may distribute the washing water to at least one of a plurality of washing arms 20 or may close a fluid path through which the washing water flows.

The fluid path switch 320 may supply the washing water to one of the upper arm 21, the middle arm 22, or the lower arm 23 or may close a fluid path with respect to all of the upper arm 21, the middle arm 22, and the lower arm 23. The dishwasher according to the embodiment of the present invention further includes a washing motor 57 to generate power for sucking and exhausting the washing water. A top end and a bottom end of the body 53 are open. The washing motor 57 is disposed at the top end of the body 53. The heater 60 is disposed at the bottom end of the body 53. The washing motor 57 generates driving force to rotate the impeller 58.

The impeller 58 is rotated inside the body 53. The washing motor 57 rotates the impeller 58. The washing motor 57 is disposed at the top end of the body 53. The impeller 58 is disposed at an upper side of the body 53. An opening is formed at the upper side of the body 53. The opening is closed by a separate pump cover 59. The pump cover 59 may close the opening which is formed at the upper side of the body 53. A heater 60 is disposed at a lower side of the body 53. The heater 60 may have a circular shape. It is preferable that the heater 60 is buried not to interrupt the flow of the washing water. That is, it is not preferable that the heater 60 is disposed between the inlet port 54 and the exhaust port 55 and the steam port 56. It is preferable that the heater 60 is disposed at the lower side of the body 53 to be always immersed in the washing water. A sealer 63 may be disposed between the heater 60 and the body 53. The sealer 63 may fill a gap between the heater 60 and the body 53 to prevent the washing water from being leaked.

The fluid path switch 320 includes a fluid path switch motor 321 to generate rotating force and a rotating plate 323 which is rotated by the fluid path switch motor 321 to adjust the flow of the washing water. The rotating plate 323 selectively opens/closes a plurality of connectors (not shown) which are formed at a point in which the plurality of washing arms 20 are branched. The rotating plate 323 is formed therein with a plurality of switch holes 325*a* and 325*b*. The plurality of switch holes 325*a* and 325*b* include a first switch hole 325*a* which is circumferentially and longitudinally formed and a second switch hole 325*b* having a circular shape.

The rotating plate 323 is sequentially rotated by the fluid path switch motor 321. If the rotating plate 323 is rotated by the fluid path switch motor 321, the plurality of switch holes 325*a* and 325*b* formed at the rotating plate 323 may be located at a position corresponding to at least one of the plurality of connectors. The rotating plate 323 may rotate and close the fluid path not to communicate with all of the plurality of connectors. The fluid path switch motor 321 generates rotating force to sequentially rotate the rotating plate 323. It is preferable that the fluid path switch motor 321 is a step motor which advances by a predetermined angle each time an excited state is changed according to an input pulse signal, and maintains a constant position and stops if the excited state is not changed.

When the heater 60 generates the steam, in order to prevent the steam from flowing to the washing arm 20, the rotating plate 323 closes the fluid path through which the washing water flows. The dishwasher according to the embodiment of the present invention further includes a steam guide 15 to connect a pump with the steam nozzle 11; and a check valve 17 to block a reverse flow of the washing water to the steam guide 15 from the washing tub 5 through the steam nozzle. The steam guide 15 connects a steam port 56 with the steam 11. The steam guide 15 also connects a washing pump 50 with the steam nozzle 11. The steam guide 15 forms the fluid path through the steam flows. The steam guide 15 is disposed at the rear sidewall 8.

A plurality of steam nozzles 11 may be disposed. Preferably, a pitch P between the steam nozzles 11 may be the same as a pitch between the crests 36 of the dish rack 30 or a pitch between the troughs 37 of the dish rack 30.

The plurality of steam nozzles 11 may be disposed at a steam nozzle array 13 which is connected to the steam 15. The steam nozzle array 13 receives the steam through the steam guide 15. The steam nozzle array 13 serves as the fluid path through which the steam flows.

The check valve 17 blocks the reverse flow of the washing water. The check valve 17 blocks the reverse flow of condensed water which is formed by cooling the steam. The check valve blocks the flow of the washing water to the steam guide 15 from the steam nozzle 11. The dishwasher according to the embodiment of the present invention includes a washing tub 5 to form a dish washing space; a door 9 to open/close the washing tub 5; a washing pump 50 to suck and exhaust the washing water; a heater 60 to heat the washing water introduced into the washing pump 50; and a steam nozzle 11 to spray the steam generated by the heater 60 toward the door 9.

The washing tub 5 includes a left sidewall 6 formed at a left side of the entrance 4, a right sidewall 7 formed at a right side of the entrance 4, and a rear sidewall 8 facing the entrance 4. The rear sidewall 8 is connected with the right sidewall 7 and the left sidewall 6. The steam nozzle 11 is disposed at the door 9 and may spray the steam toward the rear sidewall 8. The heater 60 is provided in the washing pump 50 and heats the sucked water.

An operation of the dishwasher according to the embodiment of the present invention constructed as described will be explained as follows.

Figure 11:
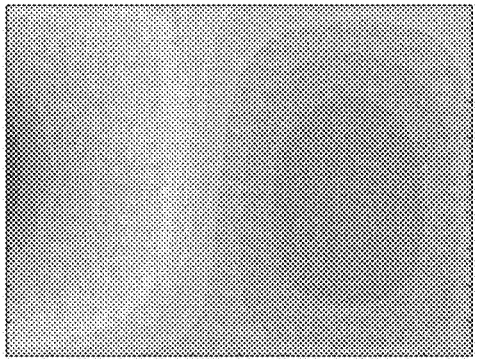
FIG. 11(*a*) shows temperature distribution inside a washing tub by a steam sprayer according to the related art.
Figure 11:
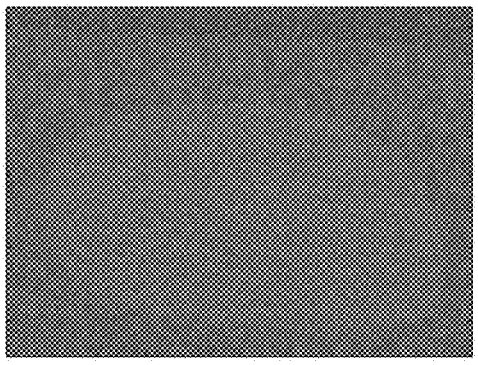

FIG. 11(*a*) shows temperature distribution inside a washing tub by a steam sprayer according to the related art, and FIG. 11(*b*) shows temperature distribution inside a washing tub when a steam is sprayed to a steam nozzle according to the present invention.

The rotating plate 323 is rotated by operating the fluid path switch motor 321. When the rotating plate 323 closes a fluid path through which the washing water flows, the heater 60 is operated. The heater 60 is disposed at a lower side of the washing pump 50 to be always immersed in the washing water. If the heater 60 is operated, a steam is generated inside the washing pump 50. The steam flows to the steam guide 15 through the steam port 56. The steam guide 15 is connected to the steam nozzle 11. The steam nozzle 11 sprays the steam between the lower rack 33 and the sump cover 19.

The steam nozzle 11 may be separately disposed between the middle rack 32 and the upper rack 31 and may spray the steam between the middle rack 32 and the upper rack 31. The steam is sprayed toward the door 9 and/or the entrance 4 from the rear sidewall 8. The dishes stand so that a gap is formed between the dishes. Accordingly, an ascending steam may pass the gap between the dishes. Since the steam has a high temperature, the steam forms an ascending gas flow and passes through the upper rack 31, and reaches a ceiling of the washing tub 5, and descends along the left sidewall 6, the right sidewall 7, and the rear sidewall 8. Accordingly, the steam is uniformly spread into the washing tub 5 to uniformly increase an internal temperature of the washing tub 5. Further, the steam makes contact with a foreign material attached to the dishes to increase food waste.

Referring to FIG. 11(*a*), according to the related art, since the steam sprayed from a steam sprayer is blocked by dishes not to be spread into the washing tub 5, a temperature is increased around the steam sprayer. However, referring to FIG. 11(*b*), when disposal of the steam nozzle 11 is changed to a longitudinal direction, an internal temperature of the washing tub 5 may be uniformly increased.

If spraying the steam is terminated, a fluid path of the washing water is opened by operating the fluid path switch motor 321. Next, the impeller 58 is rotated by operating a washing motor 57. If the impeller 58 is rotated, the washing water received in the sump 10 is guide to an inside of the washing pump 50 through an inlet port 54. The washing water introduced through the inlet port 54 is mixed with washing water heated by the heater 60 so that a mixture is moved to the washing arm 20. Accordingly, heat energy generated from the heater 60 may be reused.

The present invention has following one or more effects.

First, since the steam is moved to a gap formed between dishes, the steam is rapidly moved to a remote place so that the steam may be uniformly sprayed into a washing tub.

Second, since the internal temperature of the washing tub is uniformly increased, the washing force with respect to dishes may be uniformly increased.

Third, the heater may be disposed inside the washing pump to minimize a space of the heater.

Fourth, since high temperature water remaining after the steam is generated is flown to the washing arm, energy efficiency may be improved.

Fifth, since a spraying path of the steam is not blocked by the dishes upon spraying the dishes, the steam may be prevented from being condensed inside the tub.

Although an exemplary embodiment of the present invention has been described with reference to a number of illustrative embodiments thereof, it should be understood that numerous other modifications and embodiments can be devised by those skilled in the art that will fall within the spirit and scope of the principles of the invention.

What is claimed is:

1. A dishwasher comprising:

a washing tub forming a dish receiving space;

a sump disposed at a lower side of the washing tub;

a heater generating steam by heating washing water received in the sump;

a dish rack disposed inside the washing tub to support a plurality of dishes placed thereon, wherein the orientation of the placed dishes is such that the dish edges are aligned in the longitudinal and vertical directions of the washing tub; and steam nozzles, disposed on a sidewall of the washing tub and beneath the dish rack, wherein the steam nozzles are configured to spray steam in a direction facing the dish edges of the plurality of dishes to flow the steam between gaps of the dishes placed into the dish rack, wherein the dish rack includes crests protruding and troughs which are recessed to support in the standing orientation dishes placed thereon, wherein the steam nozzles spray steam in a direction parallel to a longitudinal direction of the crests and the troughs, wherein the steam nozzles spray the steam between adjacent crests, wherein a pitch between the steam nozzles is equal to a pitch between the troughs, wherein the dish rack comprises a lower rack which is disposed at a lowest end of the dish rack, and wherein the steam nozzles are configured to spray the steam between a bottom of the lower rack and a bottom of the washing tub.

2. The dishwasher of claim 1, wherein the washing tub comprises an entrance in which dishes are inserted into the washing tub, and a rear sidewall facing the entrance of the washing tub so that the dish receiving space is formed, and the steam nozzles are disposed at the rear sidewall to spray the steam toward the entrance.

3. The dishwasher of claim 1, further comprising:

a door to open/close the washing tub, wherein the steam nozzles are disposed in the washing tub and spray the steam toward the door.

4. The dishwasher of claim 1, wherein the washing tub comprises an entrance in which dishes are inserted into the washing tub, and a rear sidewall facing the entrance of the washing tub so that the dish receiving space is formed, wherein the dishwasher further comprises a door to open/close the washing tub, and wherein the steam nozzles are disposed at the door and spray the steam toward the rear sidewall.

5. The dishwasher of claim 1, wherein the dish rack is disposed to be plural in number by heights, and wherein the steam nozzles spray the steam between the plurality of dish racks.

6. The dishwasher of claim 5, further comprising:

a washing arm to spray the washing water to the dish receiving space; and a water guide supplying the washing water received in the sump to the washing arm, wherein the steam nozzles are disposed at right and left sides of the water guide, respectively.

7. The dishwasher of claim 6, further comprising:

a washing arm to spray the washing water to the dish receiving space; and a washing pump supplying washing water received in the sump to the washing arm, wherein the heater is provided inside the washing pump.

8. The dishwasher of claim 7, wherein the washing pump comprises:

a body forming a space in which the washing water is rotated;

an inlet port where the washing water is introduced;

an exhaust port to exhaust the washing water; and a steam port to exhaust the steam.

9. The dishwasher of claim 8, further comprising:

a washing motor providing power for sucking and exhausting the washing water, wherein a top end and a bottom end of the body are open, wherein the washing motor is disposed at the top end of the body, and wherein the heater is disposed at the bottom end of the body.

10. The dishwasher of claim 6, further comprising:

a steam guide connecting the pump with the steam nozzles; and a check valve to block a reverse flow of the washing water to the steam guide from the washing tub through the steam nozzles.

11. A dishwasher comprising:

a washing tub forming a dish receiving space;

a sump disposed at a lower side of the washing tub;

a heater generating steam by heating washing water received in the sump;

a dish rack, disposed inside the washing tub, including crests protruding and troughs which are recessed to support in a standing orientation dishes placed thereon; and steam nozzles, disposed on a sidewall of the washing tub and beneath the dish rack, wherein the steam nozzles are configured to spray steam in a direction parallel to a longitudinal direction of the crests and the troughs, wherein the steam nozzles spray the steam between adjacent crests, wherein a pitch between the steam nozzles is equal to a pitch between the troughs, wherein the dish rack comprises a lower rack which is disposed at a lowest end of the dish rack, and wherein the steam nozzles are configured to spray the steam between a bottom of the lower rack and a bottom of the washing tub.

12. The dishwasher of claim 11, wherein the washing tub comprises an entrance in which dishes are inserted into the washing tub, and a rear sidewall facing the entrance of the washing tub so that the dish receiving space is formed, and the longitudinal direction of the crests and the troughs is perpendicular to the rear sidewall of the washing tub.

13. The dishwasher of claim 12, wherein the steam nozzles are disposed at the rear sidewall and spray the steam toward the entrance.

14. The dishwasher of claim 12, further comprising:

a door to open/close the washing tub, wherein the steam nozzles are disposed at the door and spray the steam toward the rear sidewall.

15. The dishwasher of claim 11, wherein the washing tub comprises an entrance in which dishes are inserted into the washing tub, and a rear sidewall facing the entrance of the washing tub so that the dish receiving space is formed, wherein the longitudinal direction of the crests and the troughs is parallel to the rear sidewall of the washing tub, and wherein the steam nozzles are disposed in at least one of a left sidewall and a right sidewall of the washing tub and spray the steam parallel to the rear sidewall.

16. The dishwasher of claim 11, wherein the steam nozzles spray the steam between adjacent troughs.

* * * * *